US012162061B2

(12) United States Patent
Zahle et al.

(10) Patent No.: US 12,162,061 B2
(45) Date of Patent: Dec. 10, 2024

(54) STRAIGHTENING DEVICE FOR ALIGNING A LINE, METHOD FOR BRAKING AT LEAST ONE ROTATABLE ROLLER IN A STRAIGHTENING DEVICE, CABLE PROCESSING MACHINE WITH A STRAIGHTENING DEVICE, AND UPGRADE KIT FOR A CABLE PROCESSING MACHINE

(71) Applicant: SCHLEUNIGER AG, Thun (CH)

(72) Inventors: Andreas Zahle, Radevormwald (DE); Otto Vogt, Hückeswagen (DE)

(73) Assignee: Schleuniger AG, Thun (CH)

( * ) Notice: Subject to any disclaimer, the term of this patent is extended or adjusted under 35 U.S.C. 154(b) by 255 days.

(21) Appl. No.: 17/612,723

(22) PCT Filed: May 19, 2020

(86) PCT No.: PCT/IB2020/054722
§ 371 (c)(1),
(2) Date: Nov. 19, 2021

(87) PCT Pub. No.: WO2020/234758
PCT Pub. Date: Nov. 26, 2020

(65) Prior Publication Data

US 2022/0234093 A1 Jul. 28, 2022

(30) Foreign Application Priority Data

May 20, 2019 (EP) ..... 19175428

(51) Int. Cl.
*B21F 1/02* (2006.01)
*B65H 7/14* (2006.01)
(Continued)

(52) U.S. Cl.
CPC ..... *B21F 1/02* (2013.01); *B65H 57/14* (2013.01); *B65H 59/16* (2013.01); *B65H 2701/32* (2013.01); *B65H 2701/34* (2013.01)

(58) Field of Classification Search
CPC .. B21F 1/02; B65H 59/16; B21D 3/02; B21D 3/05
(Continued)

(56) References Cited

U.S. PATENT DOCUMENTS 3,348,400 A 10/1967 Korf
3,881,578 A 5/1975 Dubreucq
(Continued)

FOREIGN PATENT DOCUMENTS

CN 101912934 B * 1/2012
CN 102 556 102 A 7/2012
(Continued)

OTHER PUBLICATIONS

English translate (ES2045294T3), retrieved date Jan. 15, 2024.*
(Continued)

*Primary Examiner* — Mohammed S. Alawadi
(74) *Attorney, Agent, or Firm* — Finch & Maloney PLLC

(57) ABSTRACT

A straightening device (15) for aligning a line (11) along a delivery route. The device including a straightening stand (20) having a first row of rollers (21) and a second row of rollers (31) which rows can be moved relative to one another and between which the delivery route of the line runs. At least one of the two rows of rollers (21, 31) has a plurality of rotatable rollers (25, 35). A braking device (40) is provided for braking at least one of the rotatable rollers (25, 35) of at least one of the two rows of rollers (21, 31) in the straightening stand. A method for braking at least one rotatable roller (25, 35) of at least one of the two rows of rollers (21, 31) in a straightening device, a cable processing
(Continued)

machine with a straightening device, and an upgrade kit for a cable processing machine.

15 Claims, 3 Drawing Sheets

(51) Int. Cl.
*B65H 57/14* (2006.01)
*B65H 59/16* (2006.01)
*D07B 5/12* (2006.01)

(58) Field of Classification Search
USPC ..... 72/205
See application file for complete search history.

(56) References Cited

U.S. PATENT DOCUMENTS

| | | | | |
|---|---|---|---|---|
| 4,920,776 | A | 5/1990 | Denzler | |
| 5,216,217 | A | 6/1993 | Morishita et al. | |
| 5,238,095 | A * | 8/1993 | Pedu | H02K 49/065 192/84.1 |
| 8,978,435 | B2 | 3/2015 | Viviroli | |
| 2011/0315266 | A1* | 12/2011 | Viviroli | B65H 57/14 140/147 |

FOREIGN PATENT DOCUMENTS

| | | | | |
|---|---|---|---|---|
| CN | 103303150 | A * | 9/2013 | |
| CN | 107052199 | A | 8/2017 | |
| DE | 10 2013 002 020 | A1 | 8/2014 | |
| EP | 2 399 856 | A1 | 12/2011 | |
| EP | 3 290 370 | A1 | 3/2018 | |
| ES | 2045294 | T3 * | 1/1994 | B21D 3/04 |
| GB | 566596 | A | 1/1945 | |
| JP | S62-248528 | A | 10/1987 | |
| JP | H01-107931 | A | 4/1989 | |
| JP | H06-39466 | A | 2/1994 | |
| JP | 2013-021137 | A | 1/2013 | |

OTHER PUBLICATIONS

English translate (CN103303150A).*
Neodymium magnet, retrieved date Jan. 16, 2024.*
English translate (CN101912934B), retrieved date Jul. 29, 2024.*
European Office Action Corresponding to 19175428.2 mailed Sep. 15, 2021.
International Search Report Corresponding to PCT/IB2020/054722 mailed Sep. 3, 2020.
Written Opinion Corresponding to PCT/IB2020/054722 mailed Sep. 3, 2020.
Chinese Office Action Corresponding to 202080037297.2 mailed Oct. 10, 2023.

* cited by examiner

STRAIGHTENING DEVICE FOR ALIGNING A LINE, METHOD FOR BRAKING AT LEAST ONE ROTATABLE ROLLER IN A STRAIGHTENING DEVICE, CABLE PROCESSING MACHINE WITH A STRAIGHTENING DEVICE, AND UPGRADE KIT FOR A CABLE PROCESSING MACHINE

This application is a National Stage completion of PCT/IB2021/054722 filed May 19, 2020, which claims priority from European patent application serial no. 19175428.2 filed May 20, 2019.

FIELD OF THE INVENTION

The invention relates to a straightening device for aligning a line, a method for braking at least one rotatable roller in a straightening device, a cable processing machine with a straightening device, and an upgrade kit for a cable processing machine.

BACKGROUND OF THE INVENTION

As the number of electronic assemblies in industry grows, so the requirements regarding the quality of the cable sets and cable connections between the assemblies also become more stringent. This in turn means that it is becoming all the more important when processing lines and cables to monitor the line or cable constantly, from the drawing process, through the cutting to length and further processing at the processing stations of the cable processing machines, and avoid damaging the lines.

The increasing number of lines needed also means that cable processing machines must work faster and faster. The output quantity of the cable processing machines is a significant economic factor, and besides quality it is a decisive consideration in the customers' purchasing decision.

Fully automatic work machines for cable processing must be able to perform processing operations such as cutting to length, insulation stripping, crimping, twisting and tin-plating, as rapidly as possible. Further processing steps, such as welding of lines and automatic winding of the processed lines are available as options. For this purpose, continuous lines are typically drawn from a container, a cable reel or cable drum for example, into the cable processing machine, and aligned by a straightening stand. In this process, the straightening process relaxes the line, minimises its intrinsic torsion and enables axially aligned further process thereof.

EP 2 399 856 A1 discloses a straightening stand for aligning lines which has an upper and a lower row of rollers. Both of these rows of rollers can be moved relative to each other, and in this process the delivery route of the line between passes through the two rows of rollers. The rows of rollers include a plurality of rollers which rotate in order to align the line.

JP S62 248 528 A discloses an apparatus for straightening rolled, cold-drawn and annealed steel wire, in order to minimise the torsional stress in the wire and subsequently produce coil springs. The apparatus comprises two straightening stands, each having two rows of straightening rollers, wherein the straightening stands straighten the wire mechanically in two planes two planes.

The drawback of the known apparatuses is that during the final stopping operation the line to be aligned is only braked by friction of the rollers and walking forces in the line or wire.

EP 3 290 370 A1 discloses a wire running apparatus for feeding a wire into a feed device. The wire apparatus comprises a braking apparatus with a brake roller and with a pressure roller as the contact pressure element. The brake roller and the pressure roller are arranged opposite one another and are movable relative to each other. Pressure is applied to the wire between the brake roller and the pressure roller, and the wire is braked thereby as necessary.

The drawback associated with this known apparatus is that the wire is braked mechanically, which gives rise to a substantial amount of friction-based heat, and consequently the wire is deformed during braking.

U.S. Pat. No. 3,881,578 A discloses a magnet-assisted braking device for rail vehicles, with brake blocks for decelerating the rotary motion of the running wheels on the rail vehicle. A magnetic coil to which an electrical voltage can be applied is arranged on a ferromagnetic connecting member between the running wheels, and with the ferromagnetic brake blocks forms a closed magnetic circuit through the running wheels and stationary rails, wherein an additional attractive braking friction force of the brake blocks on the running wheels is generated by means of the magnetic flux.

The drawback of this known solution is that the magnet-assisted braking apparatus gives rise to a substantial amount of frictional heat in the running wheels and said braking apparatus is consequently not suitable for a cable processing apparatus.

A braking apparatus of similar species to the solution described above for a rail vehicle is disclosed in CN 102 556 102 A, although this disclosure does not describe direct braking of the rail vehicle's running wheels and is unsuitable as a braking apparatus for a cable processing apparatus.

DE 10 2013 002 020 A1 discloses a winding apparatus for winding a strand-like material to be wound having a winding drum and a movable laying arm. An eddy current brake is mounted on the laying arm as a brake for the material to be wound, and transmits a braking force directed away from the winding drum to the material to be wound as necessary. With the generation of the braking force on the material to be wound, the material to be wound is placed under pretension by tensile force downwards in the direction of delivery to the brake for the material to be wound.

The drawback of this known apparatus is that the braking force of the brake for the material to be wound acts directly on the material, with the result that a tensile force is applied to the material that is to wound, and consequently the material is unavoidably deformed.

SUMMARY OF THE INVENTION

It is the object of the present invention to remedy one or more drawbacks of the related art. In particular, it is intended to create a straightening device in which damage to the line to be aligned due to the effects of friction during braking of said line to be aligned is prevented, as well as a method for braking at least one rotatable roller in a row of rollers of a straightening device, which brings about gentle braking of the line to be aligned. Moreover, a cable processing machine equipped with the straightening device is to be created, in which machine the quality requirements applicable to the line to be aligned can be maintained and an interruption of the processing operation because a line was damaged during the alignment can be avoided, and an upgrade kit for a cable processing machine may be created, with which a cable processing machine can be upgraded.

This object is solved with the apparatuses and methods defined in the independent claims. Advantageous further developments are presented in the figures, the description and in particular in the dependent claims.

A straightening device according to the invention for aligning a line along a delivery route comprises a straightening stand with a first row of rollers and with a second row of rollers, which are movable relative to each other, and between which the delivery route of the line extends, wherein at least one of the two rows of rollers has a plurality of rotatable rollers, and wherein a braking apparatus is provided for braking at least one of the rotatable rollers of at least one of the two rows of rollers in the straightening stand n des straightening stand.

In this context, the braking apparatus is designed to exert a braking effect on the roller of at least one of the two rows of rollers which rotates while the line is being aligned, thereby enabling an effective deceleration of said roller without mechanically overloading or deforming the line that is to be aligned. The line to be aligned is drawn through the straightening stand by means of a line drawing device. Because of the high speeds at which the line is drawn into the straightening stand during alignment of the line and the resulting high rotational energy of the rotating rollers in the rows of rollers, stopping the extremely rapidly moving line drawing device typically causes a loop to form in the line between the straightening stand and the line drawing device. This loop formation stems from the mass inertia of the rotating rollers in the rows of rollers in the straightening device and is caused by the subsequent line lengths coming from the container. The loop in the line may subsequently lead to the line becoming caught on components in the cable processing machine, with the result that production has to be stopped. The repeated restarting of the alignment process with the straightening device in which the previously formed line loop is smoothed flat by the line drawing device, inevitably to a jerky acceleration of the line through the line drawing device, which in turn causes length errors in the line to be aligned. The direct braking of the rollers rotating in at least one of the two rows of rollers with the braking apparatus prevents the abovementioned loop formation between the straightening device and the line drawing device, and the disadvantages described previously may be avoided. In particular, production does not have to be interrupted, and a length error in der line resulting therefrom is prevented.

Prevention of loop formation and prevention of the damage that the line may possibly suffer as a result thereof is advantageous particularly in the case of electrical or optical lines, as they are particularly vulnerable to effects such as those described previously, and the quality of the aligned lines is impaired significantly thereby.

In particular, the braking apparatus is designed for braking multiple rotatable rollers of at least one of the two rows of rollers in the straightening stand, so that efficiency in the braking operation may be enhanced further, and in turn the line to be aligned is treated yet more gently. The two rows of rollers are arranged on the straightening device so that they can move relative to each other.

In an activated state, at least a portion of the braking apparatus is preferably in a contactless operative connection for braking with at least one of the rotatable rollers in at least one of the two rows of rollers. In the activated state, the braking apparatus exerts a braking effect on the at least one rotatable roller in at least one of the two rows of rollers, with the result that its rotating speed is reduced. During this process, the braking apparatus does not touch this roller, so no heat is generated in said braked roller due to mechanical friction effects.

In particular, in an activated state the braking apparatus is in a contactless operative connection for braking with multiple rotatable rollers without generating frictional heat at said multiple rotatable rollers in at least one of the two rows of rollers. With the braking apparatus such as described herein, frictional heat which would otherwise be transmitted to the line to be aligned, and which would for example cause a deformation of the power insulation and thus damage its line insulation layer, is prevented.

More preferably, the contactless operative braking connection is adjustable. In this way, the braking speed and thus also the deceleration that acts on the at least one rotatable roller, may be adapted to variable properties of the line to be aligned, such as the line diameter, the line type or the thickness of the line insulation layer. Furthermore, it is then possible to adapt a desired braking effect to the drawing speed of the line in the straightening device, thereby further reducing the harsh effects on the line during braking.

In particular, the at least one rotatable roller comprises an inner ring and an outer ring, wherein a rolling element unit, for example a ball race or the like, is arranged between the inner ring and the outer ring. The inner ring serves to attach the ball bearing and the outer ring arranged rotatably thereon securely to a stationary arbor of the first or second row of rollers in the straightening stand, wherein the inner ring is arranged statically on said stationary arbor. The rotatable outer ring is arranged rotatably on this arbor by means of the rolling element unit and is able to rotate according to the line drawing speed.

Alternatively, the at least one rotatable roller is arranged on the straightening stand on a rotatably mounted arbor and is attached fixedly to this rotatable arbor. The rotatable arbor together with the roller mounted thereon rotates about an axis of rotation, wherein said axis of rotation extends along the longitudinal extension of the rotatable arbor. This provides a simple way to mount the at least one rotatable roller rotatably on the first row of rollers or on the second row of rollers.

In particular, the contactless operative braking connection acts on the rotatable outer ring of at least one of the rotatable rollers. Consequently, the deceleration during braking acts on that region of the rotatable roller which has a larger radius and accordingly on a region with high torque, thereby further increasing the effectiveness of the contactless operative braking connection.

The rotatable outer ring of the at least one rotatable roller advantageously has a groove for guiding the line that is to be aligned. This serves to prevent the line to be aligned from departing from the straightening stand, which is undesirable.

In particular, the contactless operative braking connection acts on the rotatable outer ring of at least one more, in particular of each of the multiple rotatable rollers of the rows of rollers, thereby further improving the braking effect.

The braking apparatus is preferably a magnetic braking apparatus, wherein the magnetic braking apparatus comprises at least one permanent magnet or at least one electromagnet. Using magnets such as permanent magnets or electromagnets, it is possible to implement simple and efficient control and adjustment of the effect of braking on the at least one rotating roller.

The permanent magnets are advantageously cylindrical or disc-shaped, which enables them to be arranged in the braking apparatus easily and in keeping with the specific application. Further alternative embodiments as examples of the shape of the permanent magnets in the braking apparatus would be a square, annular, round or segmental shape.

In particular, the magnetic braking apparatus is an eddy current brake. The eddy currents induced in the at least one rotating roller by the eddy current brake are generated by the magnetic field lines, wherein a force system is created that brakes the one rotating roller or the rotating outer ring of that roller. The heat generated thereby in the one rotating roller or the rotating outer ring of that roller and the heat transmitted therefrom to the line to be aligned is negligible compared to the heating of the line that is to be aligned with mechanical braking of the line to be aligned.

Alternative, the magnetic braking apparatus is a hysteresis brake comprising at least two permanent magnets and a positioning unit for moving the at least two permanent magnets. The at least one rotatable roller such as described herein is embodied as a hysteresis disc or hysteresis ring made from a magnetic material, for example from a ferromagnetic material, the hysteresis brake. The at least two permanent magnets create a force line flux within the at least one rotatable roller. The following principle of operation applies: Opposite magnetic poles produce the lowest torque. However, the most powerful hysteresis takes place, and the torque is greatest if the south and north poles of the magnets are arranged alternatingly around the circumference of the hysteresis disc. By varying the angle of the magnetic pole superposition, the torque can be adjusted steplessly, and since there are no touching surfaces the setting is retained indefinitely. At the same time, the torque applied to the at least one rotatable roller is unaffected by the rotating speed of said roller and is this distributed evenly from standstill to maximum rotating speed.

The rotatable outer ring of the roller is advantageously made from an electrically conductive material, for example steel, copper, aluminium or the like. In this context, it is possible to generate the braking effect in the form of eddy currents with the magnetic field lines of the permanent magnet in the rotating outer ring of the at least one rotatable roller, as long as the rotatable outer ring is rotating. The eddy currents generated in the rotating outer ring of the at least one rotatable roller are strongest at high rotating speeds, and become constantly weaker as the rotating speed is reduced. The eddy currents in the rotatable outer ring of the at least one rotatable roller brake the rotation of the outer ring contactlessly and extremely effectively. When the outer ring is not rotating, no eddy currents are generated.

Also advantageously, the braking apparatus includes a magnet holder for accommodating at least one permanent magnet. The magnet holder enables simple placement of the permanent magnets on the braking apparatus. The at least one permanent magnet may be arranged detachably on the magnet holder so that it is separable from the magnet holder and the permanent magnet can be replaced without tools.

In particular, the braking apparatus includes a magnet holder for accommodating multiple permanent magnets, so that multiple permanent magnets can be involved in the operative braking connection, thereby improving the braking effect produced by the multiple permanent magnets on the at least one rotatable roller in at least one of the two rows of rollers.

More preferably, the braking apparatus is located at a distance from the at least one rotatable roller. In this context, the braking apparatus arranged with a horizontal and/or vertical separation from the at least one rotatable roller, with the result that the contactless braking apparatus has a simple, compact construction. The distance between the braking apparatus and the at least one rotatable roller allows service maintenance of the braking apparatus to be carried out without difficulty, since the components of the braking apparatus are easily accessible for a user.

The braking apparatus preferably comprises a positioning apparatus for at least partially moving the braking apparatus from a first position, in which the braking apparatus is in an inactive state, at least into a second position, in which the braking apparatus is in an activated state. In the inactive state, no braking effect at all acts on the least one rotatable roller in the row of rollers, and therefore the alignment of the line can be carried out largely without resistance. Using the positioning apparatus, the braking apparatus can be activated directly, since the distance from the braking apparatus to the at least one rotatable roller will become smaller, so that the braking effect is produced at least on this one rotatable roller in the row of rollers.

In particular, the positioning apparatus is designed as a lifting device, said lifting device being brought towards the at least one rotatable roller vertically, substantially normally to the axis of rotation of the rotatable roller. This allows a simple construction of the positioning apparatus.

Alternatively, the positioning apparatus is designed to shift the braking apparatus horizontally, substantially along the axis of rotation of the rotatable roller, so that the positioning apparatus can be arranged with low space requirement in the region of one of the rows of straightening rollers.

The magnet holder may advantageously be shifted from a first position, in which the magnet holder and the magnet is in an inactive state, into at least one second position, in which the magnet holder and the magnet is in an activated state. Thus at least one component of the braking apparatus, which is to say the magnet holder, is mounted movably on the braking apparatus. Accordingly, the number of movable components can be reduced, and consequently the construction of the braking apparatus can be designed more simply and less expensively.

The positioning apparatus is advantageously embodied as an electric crank mechanism. With the aid of an electric crank mechanism, the braking apparatus and the magnet holder can be moved from a first position to another position quickly and continuously or constantly.

More preferably, the positioning apparatus has a housing, by which the movable components of the positioning apparatus are covered, conferring a high level of safety. It may also serve to prevent a line loop from being formed on the positioning apparatus and/or a line loop from being formed inside the straightening stand of the straightening device.

In particular, the housing includes a guide section, which enables the braking apparatus to be arranged precisely and reproducibly on the straightening stand. The positioning apparatus preferably includes a drive device, which shifts at least the magnet holder pneumatically, hydraulically or electrically relative to the at least one rotatable roller. With this drive device, the magnet holder can be shifted relative to the rotatable rollers in controlled manner, wherein it advantageously adjusts the distance between the magnet holder and the at least one rotatable roller steplessly.

The positioning apparatus advantageously comprises an end plate which has at least one elastic element, such as for example a pretensioning spring. With the aid of the elastic element, it is possible to arrange at least the magnet holder on the braking apparatus such that it can be biased to prevent tilting of the magnet holder while the braking apparatus and the magnet holder is being transferred from the inactive state of the magnets to the activated state of the magnets.

More preferably, the magnet holder includes at least two permanent magnets, on each of which the magnetic south poles face substantially in the same direction. Accordingly, the existing magnetic fields of the permanent magnets have the same field line patterns, thus strengthening the operative braking connection between the at least one rotatable roller and the braking apparatus.

Preferably, at least one permanent magnet in the magnet holder is a neodymium magnet. Neodymium magnets have a particularly high field strength and are stable, so the braking apparatus needs hardly any maintenance service work.

The method according to the invention for braking at least one rotatable roller in at least one row of rollers of a straightening device such as described herein comprises at least the following steps:

aligning at least one line, wherein the at least one line is drawn through the straightening device, and braking at least one of the rotatable rollers in at least one row of rollers in the straightening device with a braking apparatus.

The method enables effective braking of said rotatable roller in one of the rows of rollers without mechanically loading or deforming the line that is to be aligned. As was disclosed earlier, this in turn prevent loop formation in the line.

The line to be aligned is advantageously unwound from a container and drawn into the straightening device. In this context, as described herein a container is understood to be a cable reel, a winding material, a cable drum or similar, in which for example a continuous line is disposed, whereby many line lengths of a continuous line can be aligned in a short time.

More preferably, at least a section of the braking apparatus is shifted from a first position, in which the braking apparatus is in an inactive state, at least into a second position, in which the braking apparatus is in an activated state before the previously described braking of the at least one rotatable roller of at least one row of rollers in the straightening device. In the inactive state of the braking apparatus no operative braking connection acts on the at least one rotatable roller of the row of rollers. Accordingly, the at least one rotatable roller is not continuously braked, which thus prevents continuous heat formation in the at least one rotatable roller of the row of rollers.

Advantageously, the magnet holder of the braking apparatus is shifted from a first position, in which the magnet holder of the braking apparatus is in an inactive state, at least into a second position, in which the magnet holder of the braking apparatus is in an activated state before the previously described braking of the at least one rotatable roller of the row of rollers in the straightening device.

The braking apparatus preferably exerts a braking effect on the at least one rotatable roller of the at least one row of rollers in the straightening device contactlessly. This prevents the generation of heat due to mechanical friction, so that the at least one rotatable roller has a long service life and consequently a long maintenance service interval.

A cable processing machine according to the invention comprises a straightening device such as described previously. As described herein, a cable processing machine comprises various processing operations, such as cutting to length, insulation stripping, crimping, twisting and tinplating. In order to ensure that these processing operations can be completed without interruption, formation of a loop between the straightening stand and the line drawing device is prevented with the aid of the straightening device as described herein.

In particular, the straightening device as described previously is arranged immediately after a container. Typically, continuous lines are drawn into a cable processing machine, and the line lengths thereof are aligned and processed further there in the abovementioned processing operations, in particular being cut to a desired length.

A control device for controlling the braking apparatus is preferably present. The control device is designed to shift at least a portion of the braking apparatus from a first position, in which the braking apparatus is in an inactive state, at least into a second position, in which the braking apparatus is in an activated state.

In particular, the control device for controlling the braking apparatus is designed as a selector switch, with which the braking apparatus can either be kept permanently in the activated state, or with which the braking apparatus can be kept alternately in the inactive or the activated state, wherein the braking apparatus is accordingly shifted from the first position into the second position according to the machine cycle of the straightening device or cable processing machine.

Alternatively or additionally, a control device for controlling the magnet holder of the braking apparatus is present. This control device is designed to shift at least the magnet holder of the braking apparatus from a first position, in which the magnet holder of the braking apparatus is in an inactive state, at least into a second position, in which the magnet holder of the braking apparatus is in an activated state.

Alternatively or additionally, a control device for controlling an electromagnet of the braking apparatus is present. This control device is designed to control the electric current in the electromagnet and thus adjust the magnetic field of the electromagnet. This enables the magnetic operative braking connection with the rotatable rollers of the at least one row of rollers to be adjusted steplessly.

Alternatively or additionally, the control device is designed to control the straightening stand. The movements of the first row of rollers and/or the second row of rollers in a straightening stand are typically controlled by means of the control device, so that the alignment of the line can be carried out in a controlled and reproducible manner. Control of the braking apparatus and the straightening stand such as described herein with a control device enables the braking of the at least one rotatable roller on the straightening stand to be matched with the movement of the first and/or second row of rollers on the straightening stand when aligning the line.

In particular, the cable processing machine has at least one further straightening stand as described earlier, wherein the at least one further straightening stand is arranged at an angle of 90° with respect to the first straightening stand, and the two straightening stands are arranged apart from and close to one another.

An arrangement at an angle of 90° to each other is understood—as described herein—to mean the arrangement of the axis of rotation of the rollers of the first straightening stand rotated through 90° relative to the axis of rotation of the rollers of the second straightening stand. This enables an improved alignment of the line in a first spatial direction and in a further spatial direction, the two spatial directions being arranged with an angular shift of 90° relative to each other.

The cable processing machine advantageously includes a line drawing device, which is arranged in a subordinate position in the delivery direction after the straightening device as described previously. In this way, the line which is be aligned can be drawn simply and automatically through the straightening device as described herein.

An upgrade kit according to the invention for a cable processing machine comprises a braking apparatus for braking at least one of the rotatable rollers in at least one row of rollers on the straightening stand, in particular for braking multiple rotatable rollers in at least one row of rollers of the straightening stand, such as is described herein. In this way, a straightening stand of a cable processing machine may be upgraded simply with a braking apparatus such as described herein.

The upgrade kit preferably comprises a control device such as is described herein which is connected to the braking apparatus such as described herein in order to control the braking apparatus such as described herein.

Further advantages, features and particularities of the invention may be discerned from the following description, in which exemplary embodiments of the invention are described with reference to the figures. Enumerations such as first, second, third or more are used solely for the purpose of identifying the components.

The list of reference numerals constitutes a component of disclosure in the same way as the technical content of the claims and the figures. The figures are described individually and with correlation to the other figures. The same reference numerals stand for identical components, reference numerals with different indices denote functionally equivalent or similar components.

DETAILED DESCRIPTION OF THE PREFERRED EMBODIMENTS

Figure 1:
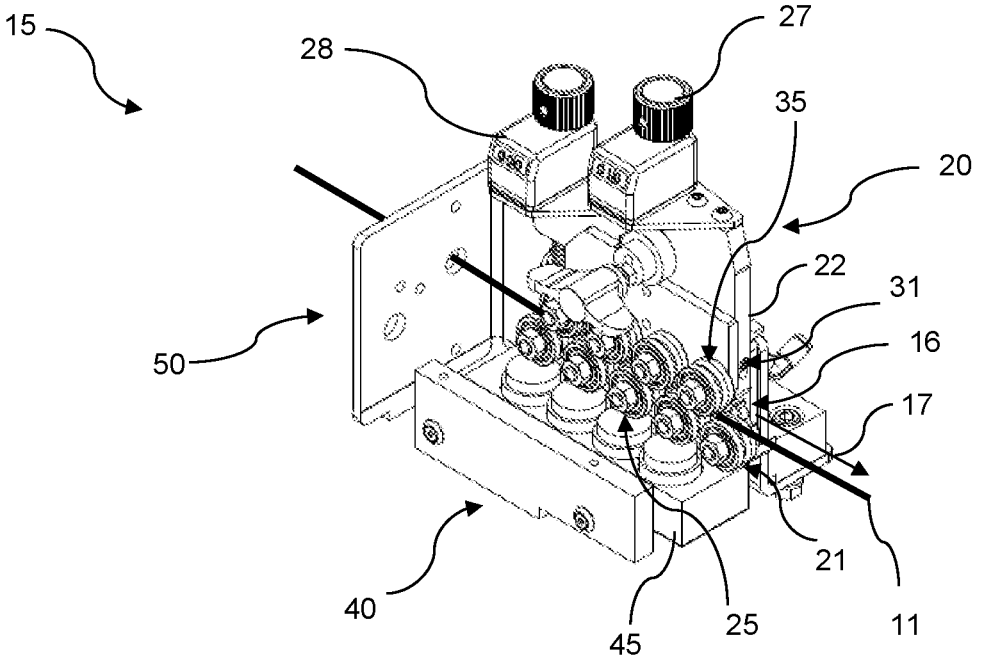
FIG. 1 is a perspective view of a first embodiment of a straightening device according to the invention.
Figure 2:
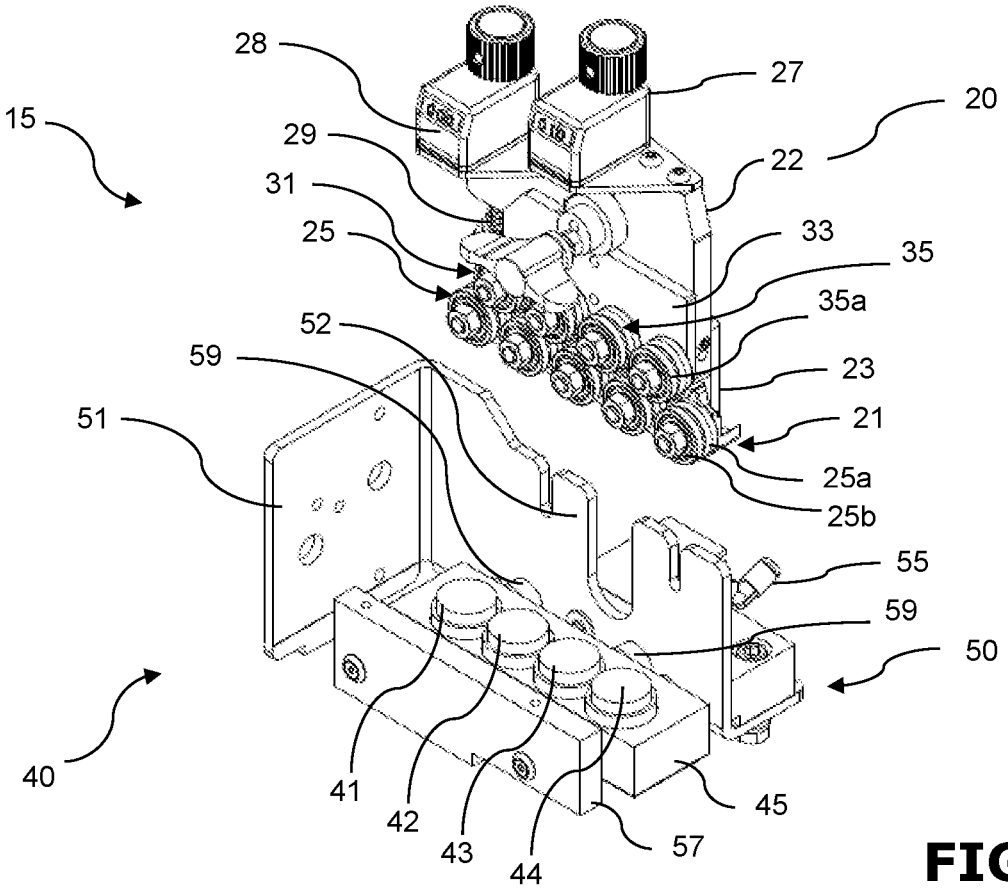
FIG. 2 is a perspective view of the straightening device of FIG. 1, wherein the straightening stand is shown separated from the braking apparatus.

FIG. 1 to FIG. 5 show a straightening device 15 for aligning an electrical or optical line 11 in a straightening stand 20 along a delivery route 16. The straightening stand 20 comprises a straightening stand housing 22, on which a first row of rollers 21 with multiple rotatably mounted rollers 25 is arranged, and on which a second row of rollers 31 with multiple rotatably mounted rollers 35 is arranged. In these figures and in the following figures, one roller 25 will be marked with the respective reference numeral to represent the plurality of rollers 25 and one roller 35 will be marked with the respective reference numeral to represent the plurality of rollers 35. The straightening stand 20 represented is in the closed state, in which the two rows of rollers 21 and 31 are positioned in close proximity to each other, and wherein the line 11 is guided between the rollers 25 and the rollers 35 and rests on the rollers 25 along a delivery direction 17. The rollers 25 are in a staggered arrangement relative to the rollers 35 along the delivery direction 17. The first row of rollers 21 is arranged on a first carrier 23, and the second row of rollers 31 is arranged on a second carrier 33. The two carriers 23 and 33 are attached to the straightening stand housing 22. The straightening stand 20 comprises a positioning drive 27 and a swivel drive 28. In this case, the positioning drive 27 comprises a pneumatically controlled drive and moves the first row of rollers 21 up to the second row of rollers 31 in such manner that the distance between the first row of rollers 21 and the second row of rollers 31 may be reduced until the rollers 35 of the second row of rollers 31 touch the line 11 and hold the line 11, or until the line 11 is clamped between the rollers 25 and the rollers 35. The swivel drive 28 comprises an adjustment spindle 29, which swivels the first row of rollers 21 through a definable angle relative to the second row of rollers 31, so that a section of the line to be aligned is clamped or retained in the straightening stand 20.

The straightening device 15 includes a magnetic braking apparatus 40 for braking the rotatable rollers 25 of the first row of rollers 21 in the straightening stand 20. The braking apparatus 40 includes a magnet holder 45 having multiple permanent magnets 41-44, wherein permanent magnets shown here have a cylindrical structure and are neodymium magnets. The magnet holder 45 is located at a distance from the rotatable rollers 25, and in an activated state is in a contactless operative braking connection with the rotatable rollers 25 of the first row of rollers 21 in the straightening stand 20. The braking apparatus 40 is also embodied as an eddy current brake, which exerts a braking effect on the rotatable rollers 25 during alignment of the line 11. In this context, the braking apparatus 40 acts in particular on the outer ring 25*a* of the rotatable rollers 25.

The braking apparatus 40 includes a positioning apparatus 50 for moving the magnet holder 45 and comprises a housing 51 and a guide section 52 arranged on the housing 51. The positioning apparatus 50 has a drive device 55, which shifts the magnet holder 45—in the present case pneumatically—relative to the at least one rotatable roller 25 or the multiple rotatable rollers 25. The positioning apparatus 50 moves the magnet holder 45 from a first position, in which the magnet holder 45 is in an inactive state (see FIG. 3), into a second position, in which the magnet holder 45 is in an activated state (see FIG. 4). The positioning apparatus 50 is designed to move the magnet holder 45 horizontally, which here means substantially normally to the axis of rotation 26 of the rotating roller 25.

The positioning apparatus 50 has an end plate 57, which is arranged on the housing 51 with the aid of cylindrical bars 59. The magnet holder 45 has boreholes which accommodate the cylindrical bars 59 singly. The magnet holder 45 is mounted on the cylindrical bars 59 so as to be movable towards the end plate 57. Pretensioning springs 58 are arranged on the cylindrical bars 59 and they bias the magnet holder 45 against the housing 51, so that tilting of the magnet holder 45 when the magnet holder 45 is transferred from a first position to a second Position can be prevented.

The braking apparatus 40 is connected to a control device 80 for controlling the braking apparatus 40. The control device 80 is connected to the positioning apparatus 50 via control lines 81 and is designed to shift the magnet holder 45 from a first position, in which the braking apparatus 40 and die magnet holder 45 is in an inactive state, at least into a second position, in which the magnet holder 45 is in an activated state. In this way, a contactless operative braking connection may be adjusted between the permanent magnets 41-44 and the rotatable rollers 25 when aligning the line 11. In this context, the contactless operative braking connection acts primarily on the outer ring 25*a* of the rotatable rollers 25.

Figure 5:
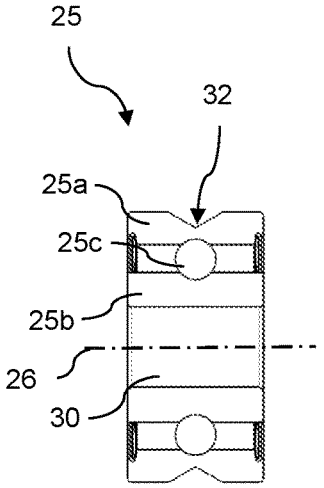
FIG. 5 is a cross-sectional view of a roller of one of the rows of rollers of the straightening stand in the straightening device of FIG. 1.

FIG. 5 shows the rotatable roller 25 which is arranged on the row of rollers 21 on the straightening stand 20. The rotatable roller 25 includes an inner ring 25*b* and an outer ring 25*a*. A ball race is arranged between the inner ring 25*b* and the outer ring 25*a* as rolling element unit 25*c*. The inner ring 25*b* serves to fasten the ball race securely on the arbor 30 of the row of rollers 21 on straightening stand 20, the inner ring 25*b* being arranged fixedly on said arbor 30. The rotatable outer ring 25*a* is arranged on said arbor 30 via the rolling element unit 25*c* so as to be rotatable about the axis of rotation 26 and rotates in accordance with the line drawing speed. The rotatable outer ring 25*a* has a groove 32 to enable centred guidance of the line 11 that is to be aligned. The rollers 35, which are positioned on the row of rollers 31 by means of an arbor, are constructed identically to the rollers 25.

In an alternative embodiment, the rollers are each arranged on the row of rollers fixedly on rotatable arbors. In this arrangement, the arbors rotate with the rollers about the axis of rotation, so the lines can be aligned in the straightening stand (not shown).

A further variant of the inventive magnetic braking apparatus (not shown here) is equipped with an electromagnet instead of the previously described permanent magnets. The magnetic field strength can be modified with the aid of the control device to adjust the magnetic operative braking connection.

Figure 3:
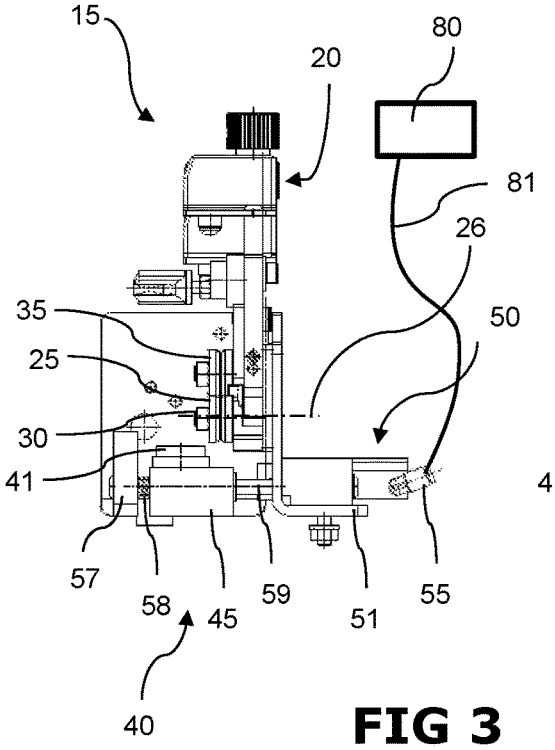
FIG. 3 is a side view of the straightening device of FIG. 1, wherein the braking apparatus is arranged in an inactive state.
Figure 4:
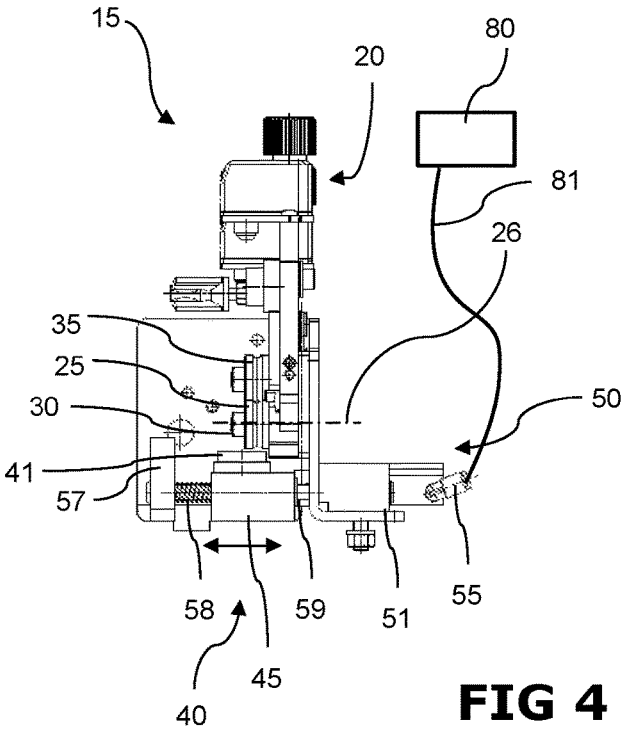
FIG. 4 is a side view of the straightening device of FIG. 1, wherein the braking apparatus is arranged in an activated state.

The method for braking the rotatable rollers 25 in the straightening device 15 will now be described with reference to FIG. 1, FIG. 3 and FIG. 4.

First, the line 11 to be aligned is unwound from a container, drawn by hand into the straightening device 15 and placed on the straightening rollers 25 of the first row of rollers 21. At this point, the straightening stand 20 is initially in an opened state, so the two rows of rollers 21 and 31 are located sufficiently far away from each other. In a further step, the straightening stand 20 is with positioned with the positioning drive 27 so that the rollers 35 of the second row of rollers 31 subsequently rest on the line 11. In addition, the second row of rollers 31 is swivelled with the aid of the swivel drive 28 and pressed onto the line 11. Then, the line 11 is aligned, wherein the line 11 is drawn through the straightening device 15. The line is drawn in by a power-driven line drawing device, which is arranged at a distance from the straightening device 15 in the delivery direction (see FIG. 7). At this time, the rollers 25 of the first row of rollers 21 and the rollers 35 of the second row of rollers 31 are caused to rotate. For the purpose of braking, the magnet holder 45 of the braking apparatus 40 is shifted from a first position, in which the magnet holder 45 of the braking apparatus 40 is in an inactive state (see FIG. 3), into a second position, in which the magnet holder 45 of the braking apparatus 40 is in an activated state (see FIG. 4). In the inactive state, the magnet holder 45 is in immediate proximity to the end plate 57, and the pretensioning springs 58 are in the compressed state. In the activated state, the magnet holder 45 is located directly below the rotating rollers 25, and the pretensioning springs 58 are in an unloaded state. In a further step, the effective braking of the rotating outer rings 25*a* of the rollers 25 of the first row of rollers 21 with the permanent magnets arranged on the magnet holder 45, wherein the braking apparatus acts in braking manner on the rotating outer rings 25*a* of the rollers 25 without touching them, according to the principle of the eddy current brake. Thus, the braking apparatus 40 is in an operative braking connection with the rotating outer rings 25*a* of the rollers 25.

In an alternative embodiment, the rotatable rollers are each arranged on a rotating axle on the row of rollers in the straightening stand and are attached fixedly to said rotatable axle. The rotatable axle rotates about an axis of rotation together with the roller arranged thereon, wherein said axis of rotation extends along the longitudinal extension of the rotatable axle. In this context, the contactless braking effect acts on the rotating rollers of the respective row of rollers (not shown).

Figure 6:
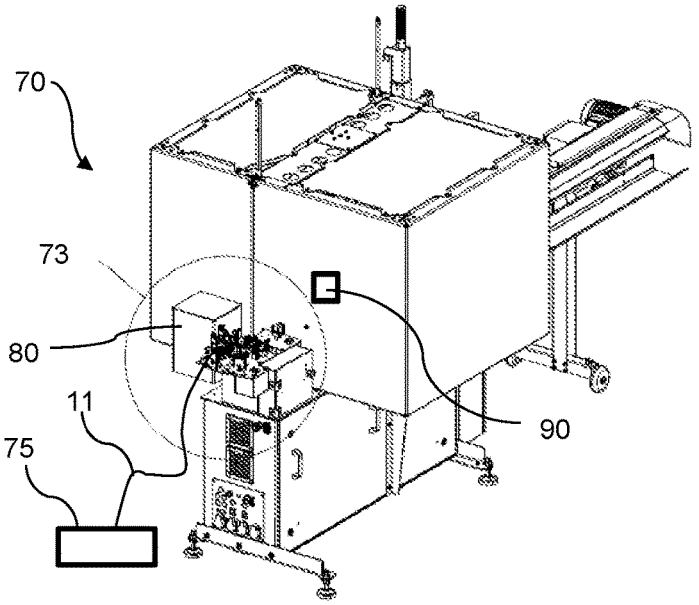
FIG. 6 is a perspective view of a cable processing machine having a straightening device according to the invention as shown in FIG. 1.

FIG. 6 shows a cable processing machine 70 according to the invention, having a straightening unit and a straightening device 15 such as described previously. As described here, the cable processing machine 70 may be designed to perform various processing operations, such as aligning, cutting to length, insulation stripping, crimping, twisting and tin-plating. A container 75 containing a line 11 in the form of a continuous line is arranged in front of the straightening device 15. The line 11 is drawn into the cable processing machine 70 and is aligned in the straightening device 15. Aline drawing device 90, which is arranged in a subordinate position in the delivery direction after the straightening device 15 is used to draw the line 11 through the straightening device 15 as will be described below.

Figure 7:
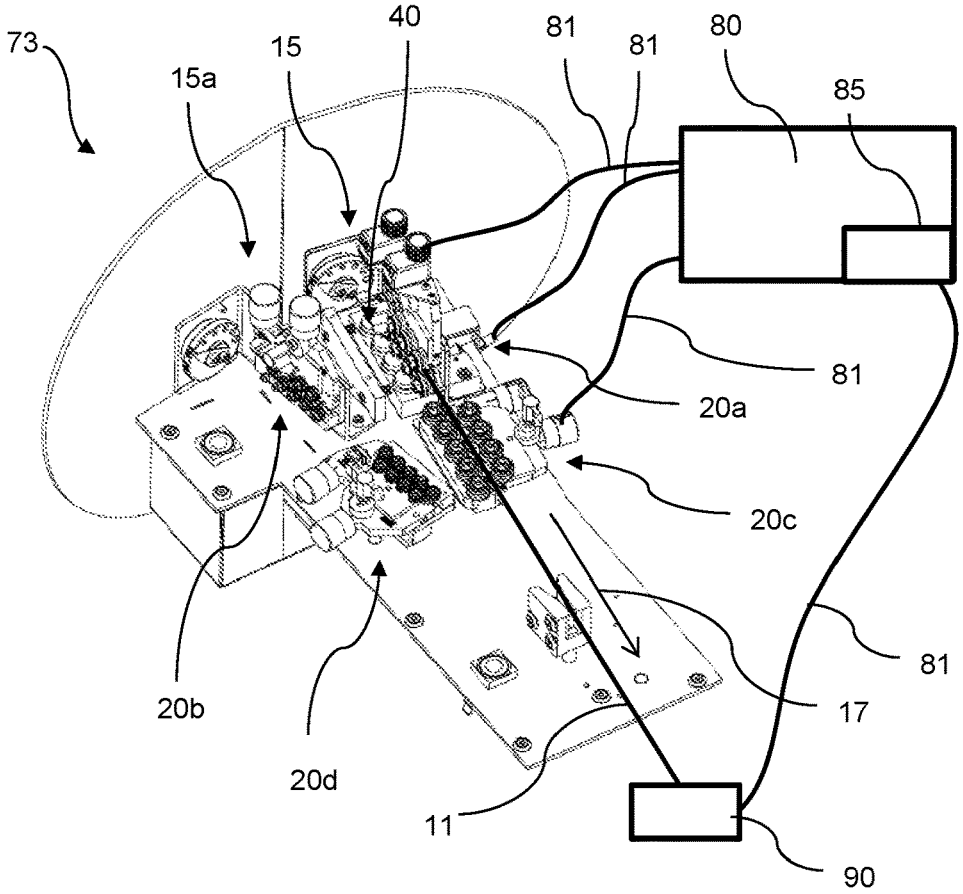
FIG. 7 is a perspective view of the straightening device according to the invention as shown in FIG. 1, and a further straightening device on the cable processing machine of FIG. 6.

FIG. 7 shows the straightening unit 73 with two straightening devices 15 and 15*a* arranged side by side, each of which has two straightening stands 20*a*-20*d*. One of these straightening devices 15, 15*a* includes a braking apparatus 40 such as described herein for braking the rotatable rollers in one of the rows of rollers in the straightening stand 20*a*. The cable processing machine 70 has a control device 80 such as described herein for controlling the braking apparatus 40 of the straightening device 15. Additionally, the control device 80 is connected electrically to the positioning drive, the swivel drives of the straightening stands 20*a* and 20*c*, and to a line drawing device 90 via the control lines 81. The line drawing device 90 of the cable processing machine 70 draws the line 11 in delivery direction 17 through the straightening stands 20*a* and 20*c*. The control device 80 contains a processor 85 which processes the control commands and transmits them to the drive device 27, 28 and 55, to the line drawing device 90, and to the braking apparatus 40 and/or the straightening stands 20*a* and 20*c*. In this context, the control commands are transmitted to the drive devices 55, the line drawing device 90 and braking apparatus 40, and to the drive devices 27, 28 of the straightening stands 20*a* and 20*c* according to a predefined step sequence. The two straightening stands 20*a* and 20*c* in a position rotated through 90° relative to each other. In an embodiment of the straightening unit which is not shown, any of the straightening stands 20*a*-20*d* shown in FIG. 7 may include a braking apparatus, such as described herein.

Figure 8:
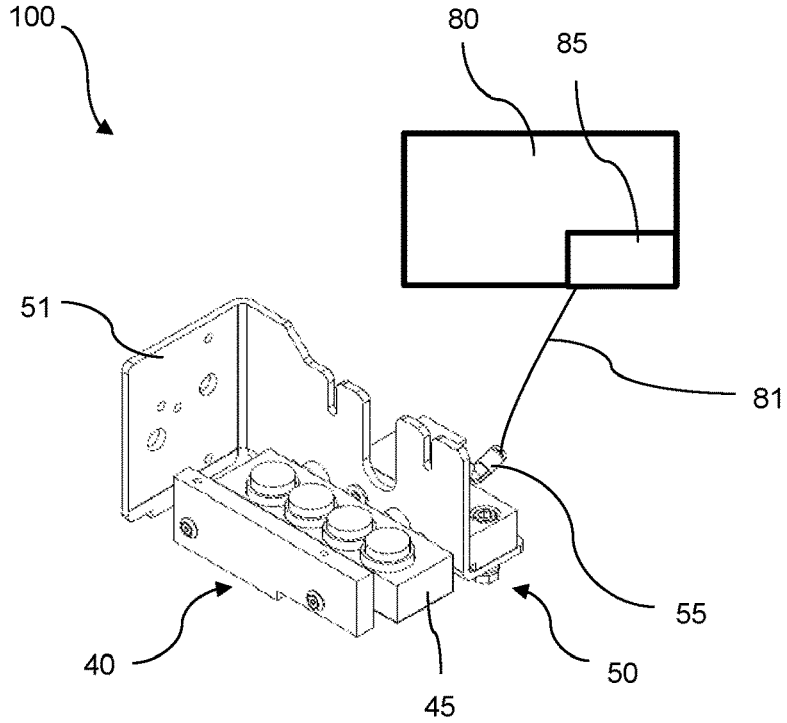
FIG. 8 is a perspective view of an upgrade kit according to the invention for a cable processing machine.

FIG. 8 shows an upgrade kit 100 according to the invention for a cable processing machine, wherein the kit contains a braking apparatus 40 such as described herein for braking at least one of the rotatable rollers in a row of rollers in a straightening stand, in particular for braking multiple rotatable rollers in a row of rollers in a straightening stand. The upgrade kit 100 includes a control device 80 with a processor 85, which is connected to the drive device 55 of the positioning apparatus 50 in order to control the braking apparatus 40.

LIST OF REFERENCE NUMERALS

11 Line
15 Straightening device
15*a* Straightening device
16 Delivery route
17 Delivery direction
20 Straightening stand
20*a*-20*d* Straightening stands
21 First row of rollers
22 Straightening stand housing
23 First carrier
25 Rollers of 21
25*a* Outer ring of 25
25*b* Inner ring of 25
25*c* Rolling element unit of 25
26 Axes of rotation of 25
27 Positioning drive
28 Swivel drive
29 Adjustment spindle
30 Arbor of 25
31 Second row of rollers
33 Second carrier
32 Groove of 25*a*
35 Rollers of 31
40 Braking apparatus
41-44 Permanent magnets
45 Magnet holder
50 Positioning apparatus
51 Housing of 50
52 Guide section
55 Drive device
57 End plate
58 Pretensioning springs
59 Cylindrical bars
70 Cable processing machine
73 Straightening unit
80 Control device
81 Control lines
85 Processor
90 Line drawing device
100 Upgrade kit

The invention claimed is:

1. A straightening device (15; 15*a*) arranged to align an electrical or optical line (11) drawn therethrough, the straightening device comprising an external line drawing device (90) configured to draw the electrical or optical line along a delivery route (16) through a straightening stand in a repeated stop/restart fashion manner, the straightening stand (20; 20*a*-20*d*), has two rows of rollers (21, 31) which are movable relative to each other and between which the delivery route of the electrical or optical line passes, wherein at least one of the two rows of rollers (21, 31) has a plurality rotatable rollers (25, 35), the straightening device further comprising a braking apparatus (40) for braking at least one of the plurality of rotatable rollers (25, 35) from the at least one of the two rows of rollers (21, 31) in the straightening stand (20; 20*a*-20*d*), and a control device having a processor which processes control commands and transmits the control commands to the external line drawing device, the braking apparatus, and to drive devices of the straightening stand according to a predefined step sequence.

2. The straightening device (15; 15*a*) according to claim 1, wherein in an activated state at least a portion of the braking apparatus (40) is in a contactless operative braking connection with the at least one of the plurality of rotatable rollers (25, 35) in the straightening stand (20; 20*a*-20*d*).

3. The straightening device (15; 15*a*) according to claim 2, wherein the contactless operative braking connection is adjustable, and acts on a rotatable outer ring (25*a*) of the at least one of the plurality of rotatable rollers (25, 35).

4. The straightening device (15; 15*a*) according to claim 1, wherein the braking apparatus (40) is a magnetic braking apparatus, wherein the magnetic braking apparatus comprises at least one permanent magnet (41-44) or at least one electromagnet, and wherein the magnetic braking apparatus is an eddy current brake or a hysteresis brake.

5. The straightening device (15; 15*a*) according to claim 4, wherein the braking apparatus (40) further comprises a magnet holder (45) for accommodating at least one permanent magnet (41-44).

6. The straightening device (15; 15a) according to claim 5, wherein the positioning apparatus (50) has a drive device (55), which displaces at least the magnet holder (45) relative to the at least one rotatable roller (25, 35) pneumatically, hydraulically or electrically.

7. The straightening device (15; 15*a*) according to claim 5, wherein the magnet holder (45) has at least two permanent magnets (41-44), the magnetic south poles of the at least two permanent magnets face in substantially the same direction.

8. The straightening device (15; 15a) according to claim 5, wherein the at least one permanent magnet (41-44) in the magnet holder (45) is a neodymium magnet.

9. The straightening device (15; 15a) according to claim 1, wherein the braking apparatus (40) is located at a distance from the at least one rotatable roller (25, 35).

10. The straightening device (15; 15a) according to claim 1, wherein the braking apparatus (40) comprises a positioning apparatus (50) for at least partially moving the braking apparatus (40) from a first position, in which the braking apparatus (40) is in an inactive state, at least into a second position, in which the braking apparatus (40) is in an activated state.

11. The straightening device (15; 15a) according to claim 6, wherein the positioning apparatus (50) has a housing (51), wherein the housing has a guide section (52).

12. A method for braking the at least one of the plurality of rotatable rollers (25, 35) from the at least one of the two rows of rollers (21, 31) in the straightening device (15; 15*a*) according to claim 1, wherein the method comprises the following steps:

aligning the electrical or optical line (11), wherein the electrical or optical line (11) is drawn through the straightening device (15; 15*a*), and braking the at least one of the plurality of rotatable rollers (25, 35) from the at least one of the two rows of rollers (21, 31) in the straightening device (15; 25) with the braking apparatus (40).

13. The method according to claim 12, wherein at least a portion of the braking apparatus (40) is shifted from a first position, in which the braking apparatus (40) is in an inactive state, into a second position, in which the braking apparatus (40) is in an activated state.

14. The method according to claim 12, wherein the braking apparatus (40) acts in braking manner contactlessly on the at least one rotatable roller (25, 35) of the at least one row of rollers (21, 31) in the straightening device (15; 15*a*).

15. A cable processing machine (70), comprising the straightening device (15; 15*a*) according to claim 1, wherein the straightening device (15; 15*a*) is arranged immediately after a container (75), and the cable processing machine further comprises the control device (80) for controlling the braking apparatus (40), and wherein said control device (40) is designed to control drive the devices of the straightening stand (20; 20*a*-20*d*).

* * * * *